US009252568B2

(12) United States Patent
Kachikawa

(10) Patent No.: US 9,252,568 B2
(45) Date of Patent: Feb. 2, 2016

(54) SPARK PLUG HAVING GROUND ELECTRODE WELDED TO METAL SHELL

(75) Inventor: Norihide Kachikawa, Seto (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 511 days.

(21) Appl. No.: 13/697,385

(22) PCT Filed: May 6, 2011

(86) PCT No.: PCT/JP2011/002556

§ 371 (c)(1),
(2), (4) Date: Dec. 4, 2012

(87) PCT Pub. No.: WO2011/142106

PCT Pub. Date: Nov. 17, 2011

(65) Prior Publication Data

US 2013/0069517 A1 Mar. 21, 2013

(30) Foreign Application Priority Data

May 13, 2010 (JP) ..... 2010-110857

(51) Int. Cl.
*H01T 13/32* (2006.01)
*H01T 13/39* (2006.01)
*F02P 13/00* (2006.01)

(52) U.S. Cl.
CPC ..... *H01T 13/32* (2013.01); *H01T 13/39* (2013.01); *F02P 13/00* (2013.01)

(58) Field of Classification Search
CPC ..... H01T 13/32; H01T 13/39; H01T 21/02
See application file for complete search history.

(56) References Cited

U.S. PATENT DOCUMENTS

| | | | | |
|---|---|---|---|---|
| 5,530,313 | A * | 6/1996 | Chiu | 313/141 |
| 6,285,008 | B1 * | 9/2001 | Fleetwood et al. | 219/270 |
| 6,819,033 | B2 | 11/2004 | Kanao et al. | 313/141 |
| 7,224,109 | B2 | 5/2007 | Kanao | 313/141 |
| 2001/0030494 | A1 | 10/2001 | Kanao | 313/141 |

(Continued)

FOREIGN PATENT DOCUMENTS

| | | | |
|---|---|---|---|
| JP | 2121289 | 5/1990 | B21D 53/84 |
| JP | 2001-284013 A | 10/2001 | H01T 13/20 |

(Continued)

OTHER PUBLICATIONS

Machine Translation of JP 2006-316343, retrieved Mar. 11, 2015.*

(Continued)

*Primary Examiner* — Anh Mai
*Assistant Examiner* — Steven Horikoshi
(74) *Attorney, Agent, or Firm* — Kusner & Jaffe

(57) ABSTRACT

A spark plug includes a center electrode, a ground electrode formed of a metal material containing 95% or more of nickel and a substantially cylindrical metal shell having a front end face to which one end of the ground electrode is welded. In the spark plug, the conditions: 0.15 mm≤BD≤0.40 mm; and (EW2−EW1)/EW1≥0.1 are satisfied where BD is a depth from the front end face of the metal shell to a portion of the ground electrode embedded most deeply in the metal shell; EW1 is a width of a portion of the ground electrode located closest to a portion of the ground electrode deformed by the welding; and EW2 is a width of the portion of the ground electrode deformed by the welding at the front end face of the metal shell.

7 Claims, 6 Drawing Sheets

(56) References Cited

U.S. PATENT DOCUMENTS

| | | | | |
|---|---|---|---|---|
| 2003/0038578 | A1 | 2/2003 | Kanao et al. | 313/144 |
| 2009/0009048 | A1 | 1/2009 | Yoshimoto et al. | 313/142 |

FOREIGN PATENT DOCUMENTS

| | | | | | |
|---|---|---|---|---|---|
| JP | 2003-059617 | A | | 2/2003 | F23Q 3/00 |
| JP | 2003-223968 | | | 8/2003 | H01T 13/02 |
| JP | 2005-339864 | A | | 12/2005 | H01T 13/20 |
| JP | 2006316343 | A | * | 11/2006 | |
| JP | 2009-016278 | A | | 1/2009 | C22C 19/03 |
| JP | 2009-129908 | | | 6/2009 | H01T 13/32 |

OTHER PUBLICATIONS

Supplementary European Search Report received in corresponding European Patent Application No. 11780365.0, dated May 27, 2014.

Form PCT/ISA/210—Int'l Search Report (from corresponding Int'l Patent App. No. PCT/JP2011/002556—English version only); 1 page.

* cited by examiner

SUPERSATURATED SOLID SOLUTION

INTERMETALLIC COMPOUND CRYSTAL GRAIN SIZE: SMALLER THAN 5 μm

INTERMETALLIC COMPOUND CRYSTAL GRAIN SIZE: 5~20 μm

SPARK PLUG HAVING GROUND ELECTRODE WELDED TO METAL SHELL

TECHNICAL FIELD

The present invention relates to a spark plug mounted to an internal combustion engine.

BACKGROUND ART

In recent years, there has been a demand to increase the valve diameter of intake and exhaust valves for high-output performance of internal combustion engines. There has also been a demand to provide larger water jackets for efficient cooling of high-output internal combustion engines. In response to these demands, the installation spaces of spark plugs in the internal combustion engines are limited. It is thus required to decrease the diameter of spark plugs.

It is further required that the spark plugs have high ignition performance in order to cope with the strong demand for low emissions from recent internal combustion engines. For the above reasons, the spark plug has a ground electrode of as large dimensions as possible welded to a metal shell even when the metal shell is reduced in diameter. However, the fused joint between the metal shell and the ground electrode decreases in size as the thickness of the ground electrode increases with increasing dimensions and becomes close to the thickness of the metal shell (see for example, Japanese Laid-Open Patent Publication No. 2003-223968). This leads to a deterioration in the joint strength between the metal shell and the ground electrode.

In view of the above problems, it is an advantage of the present invention to provide a spark plug capable of securing the joint strength between a ground electrode and a metal shell even when the spark plug is reduced in diameter.

SUMMARY OF THE INVENTION

The present invention has been made to solve at least part of the above problems and can be embodied in the following aspects or application examples.

Application Example 1

In accordance with the present invention, there is provided a spark plug, comprising: a center electrode extending in an axial direction of the spark plug; a ground electrode formed of a metal material containing 95 mass % or more of nickel; and a substantially cylindrical metal shell having a front end face to which one end of the ground electrode is welded, wherein an embedment amount BD, an original width EW1 and a deformation width EW2 satisfy the conditions: 0.15 mm≤BD≤0.40 mm; and (EW2−EW1)/EW1≥0.1 where the embedment amount BD is a depth from the front end face of the metal shell to a portion of the ground electrode embedded most deeply in the metal shell by the welding of the ground electrode and the metal shell; the original width EW1 is a width of a portion of the ground electrode located closest to a portion of the ground electrode deformed by the welding; and the deformation width EW2 is a width of the portion of the ground electrode deformed by the welding at the front end face of the metal shell.

In the above-configured spark plug, the ground electrode has an increased thermal conductivity due to its very high nickel content of 95 mass % or more and thus can be welded to the metal shell in such a manner as to embed the portion of the ground electrode in the metal shell. Even when the spark plug is reduced in diameter, it is possible to secure the joint strength between the ground electrode and the metal shell by setting the depth of embedment (embedment amount BD) and the original width EW1 and deformation width EW2 of the ground electrode so as to satisfy the above conditions (0.15 mm≤BD≤0.40 mm and (EW2−EW1)/EW1≥0.1).

Application Example 2

In accordance with another aspect of the present invention, there is provided a spark plug according to Application Example 1, wherein the original width EW1 and the deformation width EW2 satisfy the condition: (EW2−EW1)/EW1≥0.16.

It is possible to secure the joint strength between the ground electrode and the metal shell more assuredly by setting the original width EW1 and the deformation width EW2 of the ground electrode so as to satisfy the above condition.

Application Example 3

In accordance with another aspect of the present invention, there is provided a spark plug according to Application Examples 1 or 2, wherein the spark plug has a removed surface region defined by removing, in the axial direction, at least a portion of a protruded part that has been formed in a thickness direction of the ground electrode by the welding of the ground electrode and the metal shell; and wherein a removed surface area CS and a ground electrode cross-sectional area ES satisfy the condition: CS/ES≥1.2 where the removed surface area CS is an area of the removed surface region; and the ground electrode cross-sectional area ES is an area of a cross section taken perpendicular to the axial direction through the portion of the ground electrode located closest to the portion of the ground electrode deformed by the welding.

It is possible to secure the joint strength between the ground electrode and the metal shell more assuredly by setting the removed surface area CS and the ground electrode cross-sectional area ES so as to satisfy the above condition.

Application Example 4

In accordance with another aspect of the present invention, there is provided a spark plug according to Application Example 3, wherein the removed surface area CS and the ground electrode cross-sectional area ES satisfy the condition: CS/ES≥1.6.

It is possible to secure the joint strength of the ground electrode and the metal shell more assuredly by setting the removed surface area CS and the ground electrode cross-sectional area ES so as to satisfy the above condition.

Application Example 5

In accordance with another aspect of the present invention, there is provided a spark plug according to any one of Application Examples 1 to 4, wherein the ground electrode contains a rare earth element; wherein the spark plug comprises, at the portion of the ground electrode embedded most deeply in the metal shell, a fused layer formed of a crystal containing therein the rear earth mental and having a grain size of 20 μm or less; and wherein a fused layer thickness MH satisfies the condition: 10 μm≤MH≤200 μm where the fused layer thickness MH is a thickness of the fused layer in the axial direction.

As the rare earth element is contained in the ground electrode, the thermal conductivity of the ground electrode is made lower than that of the metal shell. This makes it easier to melt the metal shell so that the portion of the ground electrode can be favorably embedded in the metal shell by the welding. It is generally likely that, when the fused layer between the ground electrode and the metal shell is large in thickness, breakage of the ground electrode will occur starting from such a part. When the fused layer thickness MH falls within the above range, the fused layer can be made relatively small in thickness. It is thus possible to secure the joint strength between the ground electrode and the metal shell assuredly.

Application Example 6

In accordance with yet another aspect of the present invention, there is provided a spark plug according to Application Example 5, wherein the crystal is of a rare earth compound; and wherein the rare earth compound is a supersaturated solid solution containing the rare earth element.

By the presence of the supersaturated solid solution in the fused layer, the entry of foreign substance can be prevented so as to increase the grain bond strength of the fused layer. It is thus possible to secure the joint strength between the ground electrode and the metal shell more assuredly.

Application Example 7

In accordance with yet another aspect of the present invention, there is provided a spark plug according to Application Example 5, wherein the crystal is of a rare earth compound; and wherein the rare earth compound is an intermetallic compound containing the rare earth element and having a grain size of 5 μm or less.

By the presence of the intermetallic compound having a relatively small grain size of 5 μm or less in the fused layer, it is easier to distribute stress and is thus possible to secure the joint strength between the ground electrode and the metal shell more assuredly.

Application Example 8

In accordance with still another aspect of the present invention, there is provided a spark plug according to any one of Application Examples 5 to 7, wherein the grain size of the crystal containing the rare earth element in the fused layer is smaller than that of a crystal containing the rare earth element in a portion of the ground electrode undeformed by the welding.

It is possible in this configuration to secure the joint strength between the ground electrode and the metal shell more assuredly.

Application Example 9

In accordance with still another aspect of the present invention, there is provided a spark plug according to any one of Application Examples 5 to 8, wherein at least one of neodymium, yttrium and cerium is contained as the rare earth element.

By the addition of such a rare earth element to the ground electrode, it is possible to favorably embed the end portion of the ground electrode in the metal shell.

The present invention can be realized not only as the above-mentioned spark plug but also as a manufacturing method of a spark plug.

DETAILED DESCRIPTION OF PREFERRED EMBODIMENTS

Hereinafter, an exemplary embodiment and examples of the present invention will be described below with reference to the drawings.

A. Embodiment

Figure 1:
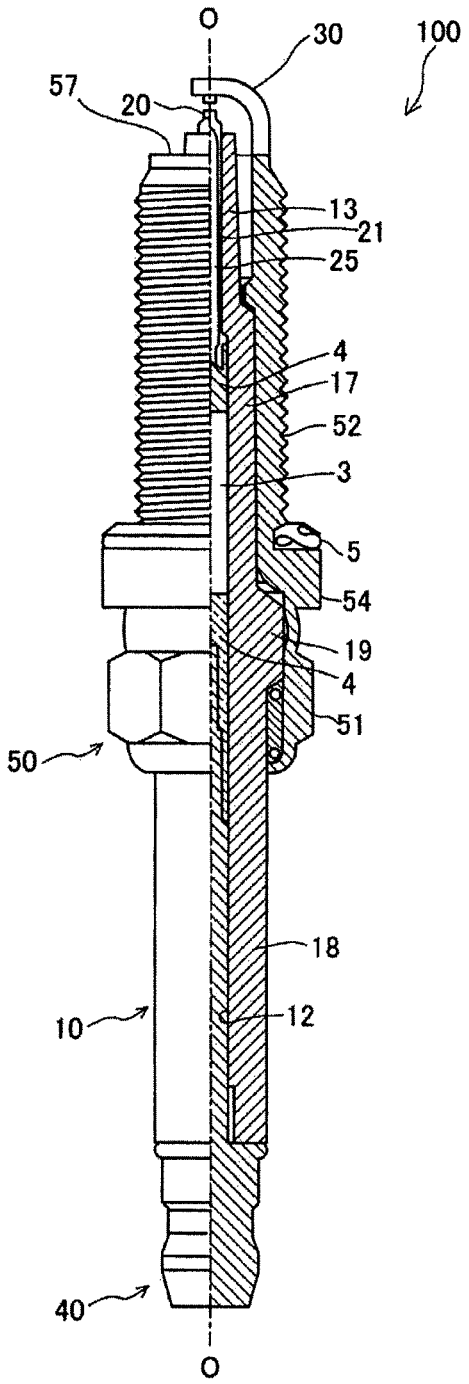
FIG. 1 is a schematic view, partly in section, of a spark plug according to one embodiment of the present invention.

FIG. 1 is a schematic view, partly in section, of a spark plug 100 according to one embodiment of the present invention. In the following explanation, upper and lower sides of FIG. 1 are referred to as front and rear sides with respect to the direction of an axis O of the spark plug 100, respectively. The spark plug 100 includes a ceramic insulator 10, a center electrode 20, a ground electrode 30, a terminal rod 40 and a metal shell 50.

The center electrode 20 is a rod-shaped electrode that protrudes from a front end of the ceramic insulator 10. The terminal rod 40 is inserted in a rear side of the ceramic insulator 10 so that the center electrode 20 is electrically connected to the terminal rod 40 within the ceramic insulator 10. An outer circumference of the center electrode 20 is retained by the ceramic insulator 10; and an outer circumference of the ceramic insulator 10 is retained by the metal shell 50 at a position apart from the terminal rod 40.

The ceramic insulator 10 is a cylindrical insulator that has, in the center thereof, an axial hole 12 in which the center electrode 20 and the terminal rode 40 are inserted. The ceramic insulator 10 is formed by sintering ceramic material such as alumina. The ceramic insulator 10 includes a middle body portion 19 located at an axially middle position thereof and having an enlarged outer diameter, a rear body portion 18 located rear of the middle body portion 19 so as to provide an insulation between the terminal rod 40 and the metal shell 50, a front body portion 17 located front of the middle body portion 19 and having an outer diameter made smaller than that of the rear body portion 18 and a leg portion 13 located front of the front body portion 17 and having an outer diameter made smaller than that of the front body portion 17 in such a manner that the outer diameter of the leg portion 13 gradually decreases toward the center electrode 20.

The metal shell 50 is a cylindrical metal fixture that surrounds and retains therein a part of the ceramic insulator 10 extending from a point on the rear body portion 18 to the leg portion 13. In the present embodiment, the metal shell 50 is formed of low carbon steel. The metal shell 50 includes a tool engagement portion 51, a mounting thread portion 52 and a seal portion 54. The tool engagement portion 51 of the metal shell 50 is engageable with a tool for mounting the spark plug 100 onto an engine head. The mounting thread portion 52 of the metal shell 50 has a screw thread screwed into a mounting thread hole of the engine head. The seal portion 54 of the metal shell 50 is formed into a flange shape at a bottom of the mounting thread portion 52. An annular gasket 5, which is formed by bending a plate material, is disposed between the seal portion 54 and the engine head (not shown). A front end face 57 of the metal shell 50 is formed into a hollow circle shape so that the center electrode 20 protrudes from the leg portion 13 of the ceramic insulator 10 through the center of the front end face 57 of the metal shell 50.

The center electrode 20 is a rod-shaped electrode including a bottomed cylindrical electrode body 21 and a core 25 having a higher thermal conductivity than that of the electrode body 21 and embedded in the electrode body 21. In the present embodiment, the electrode body 21 is formed of a nickel alloy containing nickel as a main component; and the core 25 is formed of copper or an alloy containing copper as a main component. The center electrode 20 is inserted in the axial hole 12 of the ceramic insulator 10, with a front end of the electrode body 21 protruding from the axial hole 12 of the ceramic insulator 10, and is electrically connected to the terminal rod 40 via a ceramic resistor 3 and a seal member 4.

The ground electrode 30 is joined at one end thereof to the front end face 57 of the metal shell 50 and is bent in such a manner that the other end of the ground electrode 30 faces a front end portion of the center electrode 20. In the present embodiment, the ground electrode 30 is formed of a nickel alloy containing 95 mass % or more of nickel (Ni) and 0.05 to 1.0 mass % of neodymium (Nd) as a rare earth element. As the rare earth element, yttrium (Y) and/or cerium (Ce) can be used in place of or in combination with neodymium. The ground electrode 30 may contain chromium (Cr) in addition to nickel and rare earth element. It is feasible to produce the ground electrode 30 by, for example, melting a raw material having the above contents of nickel and neodymium in a vacuum melting furnace, casing the molten material into an ingot, and then, subjecting the ingot to hot working and drawing.

Figure 2A:
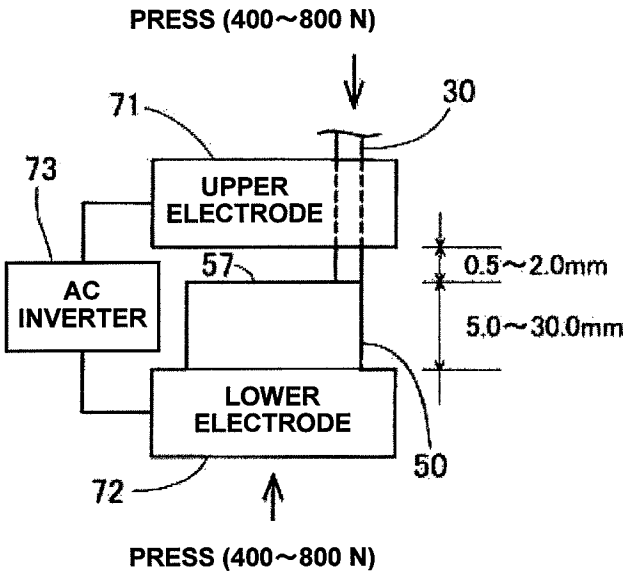
FIG. 2(*a*), FIG. 2(*b*) and FIG. 2(*c*) are schematic views showing a method for joining a rare earth element-containing ground electrode to a metal shell according to the one embodiment of the present invention.
Figure 2B:
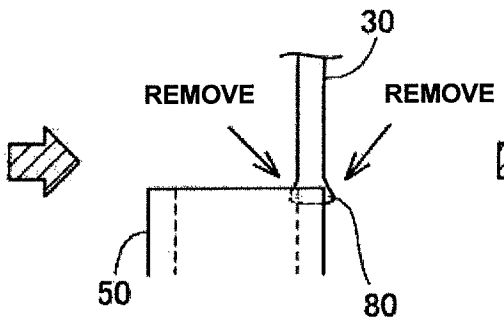
Figure 2C:
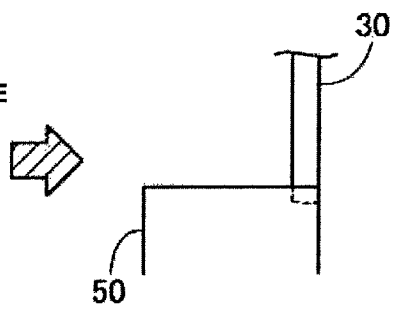
Figure 3A:
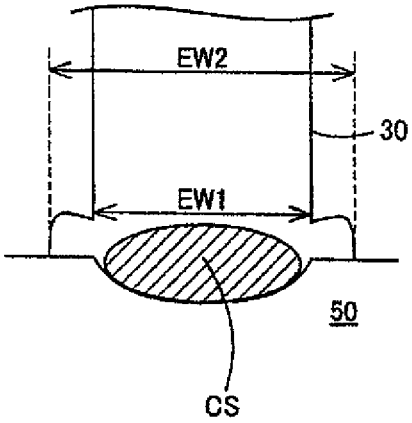
FIG. 3(*a*), FIG. 3(*b*) FIG. 3(*c*) and FIG. 3(*d*) are enlarged views of a joint between the ground electrode and the metal shell according to one embodiment of the present invention.
Figure 3B:
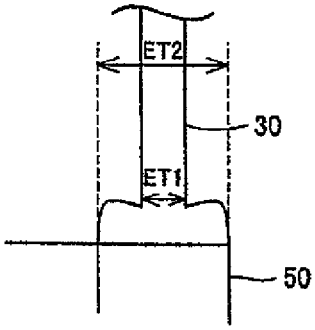
Figure 3C:
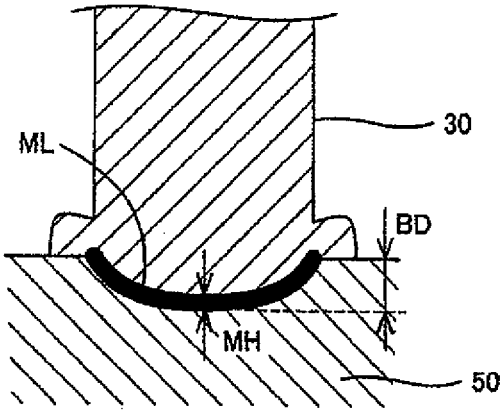
Figure 3D:
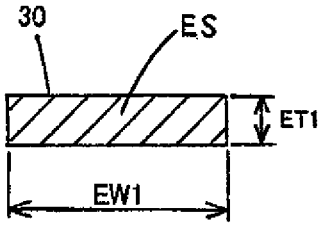

FIG. 2(*a*), FIG. 2(*b*) and FIG. 2(*c*) are schematic views showing a method for joining the rare earth element-containing ground electrode 30 to the metal shell 50. In the present embodiment, the ground electrode 30 and the metal shell 50 are first held with upper and lower electrodes 71 and 72, respectively, as shown in FIG. 2(*a*). At this time, the front end face 57 of the metal shell 50 is spaced apart by 0.5 to 2.0 mm from a lower surface of the upper electrode 71 and by 5.0 to 30.0 mm from an upper surface of the lower electrode 72.

The ground electrode 30 and the metal shell 50 are pressed together from upper and lower sides with the application of a pressure of 400 to 800 N by each of the two electrodes 71 and 72. Each of the upper and lower electrodes 71 and 72 can be formed of chromium copper, brass, beryllium copper, copper tungsten, silver tungsten, high-speed steel or the like.

The resistance welding of the ground electrode 30 and the metal shell 50 is performed by supplying a current between the upper and lower electrodes 71 and 72 from an AC inverter power supply 73 simultaneously with pressing the ground electrode 30 and the metal shell 50 together by the upper and lower electrodes 71 and 72. During the current supply, the force applied from each of the upper and lower electrodes 71 and 72 is reduced by 50 to 200 N due to melting of the ground electrode 30 and the metal shell 50. After the current supply, the ground electrode 30 and the metal shell 50 are held as they are by the upper and lower electrodes 71 and 72 for 50 to 200 msec. Although the current is supplied from the AC inverter power supply 73 in the present embodiment, it is feasible to use any other short-time/large-current power supply such as a transistor power supply or a condenser power supply.

By the above method, the ground electrode 30 and the metal shell 50 are welded together in such a manner that a rear end of the ground electrode 30 becomes embedded in the metal shell 50. In the present embodiment, the rear end of the ground electrode 30 is embedded in the metal shell 50 because the ground electrode 30 has an increased thermal conductivity due to its very high nickel content of 95 mass % or more and can easily transfer heat to the metal shell 50. It is also because the thermal conductivity of the ground electrode 30 is made lower than that of the metal shell 50 by the addition of the rare earth element to the ground electrode 30 so as to make it easier to melt the metal shell 50 than the ground electrode 30 in the present embodiment.

Upon the welding of the ground electrode 30 and the metal shell 50, welding burrs 80 (as a protruded part) occur on a front end portion of the metal shell 50 in a thickness direction of the ground electrode 30 as shown in FIG. 2(*b*). These welding burrs 80 are removed, by known machining process such as shearing or cutting, along inner and outer surfaces of the metal shell 50 in the direction of the axis O. There is thus obtained a joint assembly of the ground electrode 30 and the metal shell 50 from which the welding burrs 80 have been removed as shown in FIG. 2(*c*). The spark plug 100 is completed by, after joining the ground electrode 30 and the metal shell 50 together by the above method, assembling the ceramic insulator 10, the center electrode 20 and the like in the metal shell 50.

FIG. 3(*a*), FIG. 3(*b*) FIG. 3(*c*) and FIG. 3(*d*) are enlarged views of the joint between ground electrode 30 and the metal shell 50. More specifically, FIG. 3(*a*) is an enlarged view of the joint in a width direction of the ground electrode. In the following explanation, the width of a portion of the ground electrode 30 that is located closest to a portion of the ground electrode 30 deformed by the welding of the ground electrode 30 and the metal shell 50 is called "original width EW1"; and the width of the portion of the ground electrode 30 deformed by the welding of the ground electrode 30 and the metal shell 50 at the front end face 57 of the metal shell 50 is called "deformation width EW2". Further, the surface area of the part from which the welding burrs 80 have been removed (see FIG. 2(*b*)) is called "removed surface area CS". The removed surface area CS refers to the sum of removed surface areas of the ground electrode 30 and the inner and outer surfaces of the metal shell 50.

FIG. 3(*b*) is an enlarged view of the joint in a thickness direction of the ground electrode 30. The thickness of the portion of the ground electrode 30 that is located closest to the portion of the ground electrode 30 deformed by the welding of the ground electrode and the metal shell 50 is called "original thickness ET1"; and the thickness of the portion of the ground electrode 30 deformed by the welding of the ground electrode 30 and the metal shell 50 at the front end face 57 of the metal shell 50 (after the removal of the welding burrs) is called "deformation thickness ET2". The area of a cross section taken, in a direction perpendicular to the direction of the axis O, through the portion of the ground electrode 30 located closest to the portion of the ground electrode 30 deformed by the welding of the ground electrode 30 and the metal shell 50 is called "ground electrode cross-sectional area ES". The ground electrode cross-sectional area ES, illustrated in FIG. 3(*d*), is given by multiplication of the original width EW1 by the original thickness ET1.

FIG. 3(*c*) is an enlarged view of the joint in a width direction of the ground electrode 30. When the ground electrode 30 and the metal shell 50 are welded together by the above method of FIG. 2, there is a fused layer ML formed along a boundary between the ground electrode 30 and the metal shell 50 at a position below (rear of) the front end face 57 of the metal shell 50 as shown in FIG. 3(*c*). In the present embodiment, the fused layer ML refers to a region where the grain size of a crystal containing the rare earth element falls within the range of 20 μm or less at the boundary between the ground electrode 30 and the metal shell 50. The depth from the front end face 57 of the metal shell 50 to a portion of the ground electrode 30 (including the fused layer ML) embedded most deeply in the metal shell 50 is called "embedment amount BD". Further, the thickness of the fused layer ML at the portion of the ground electrode 30 embedded most deeply in the metal shell 50 from the front end face 57 of the metal shell 50 is called "fused layer thickness MH".

In the present embodiment, the spark plug 100 is manufactured in such a manner that the respective parameters of FIG. 3 satisfy the following conditions 1 to 4. The condition 1 is set with respect to the embedment amount BD. The condition 2 is set with respect to the rate of deformation of the ground electrode 30 in the width direction (hereinafter called "width-direction deformation rate"). The condition 3 is set with respect to the ratio of the removed surface area CS to the ground electrode cross-sectional area ES (hereinafter referred to "removed surface area ratio"). The condition 4 is set with respect to the fused layer thickness MH.

Condition 1: 0.15 mm≤BD≤0.40 mm

Condition 2: (EW2−EW1)/EW1≥0.1

Condition 3: 1.2≤CS/ES≤1.6

Condition 4: 10 μm≤MH≤200 μm

The spark plug 100 is also manufactured in such a manner that the crystal structure of the fused layer ML satisfies the following condition 5 in the present embodiment.

Condition 5: The crystal of the fused layer is of a rare earth compound that is either a supersaturated solid solution containing the rare earth element or an intermetallic compound containing the rare earth element and having a grain size of 5 μm or less.

It is possible for the spark plug 100 of the present embodiment to secure the joint strength between the ground electrode and the metal shell by satisfaction of the above conditions. The basis for the above conditions will be explained below with reference to experimental results.

B. Examples

A plurality of kinds of the ground electrode 30 having different original thickness ET1 and original width EW1 (i.e. different cross-sectional area) were prepared. By changing the current supplied between the electrodes 71 and 72 within the range of 1.5 to 3.0 KA for each kind of the ground electrode 30, a plurality of kinds of joint assemblies of the ground electrode 30 and metal shell 50 (hereinafter called "samples") were produced, in which the parameters of the above conditions 1 to 4 were varied. Each of the above-produced samples was subjected to a breaking test. In the breaking test, the ground electrode 30 was bent several times. The sample where no breakage occurred in the ground electrode 30 even when the ground electrode 30 was bent 2.5 times or more was judged as "passing (©)"; whereas the sample where a breakage occurred in the ground electrode 30 when the number of bending times of the ground electrode 30 was less than 2.5 was judged as "failing (X)". The number of bending times of 2.5 corresponds to a strength of the ground electrode 30 that can withstand normal driving of 100,000 km.

Figure 4A:
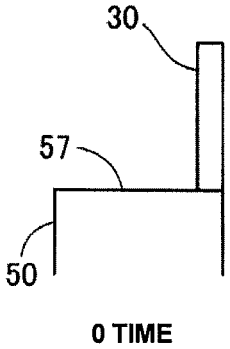
FIG. 4(*a*), FIG. 4(*b*) and FIG. 4(*c*) are schematic views showing a breaking test method.
Figure 4B:
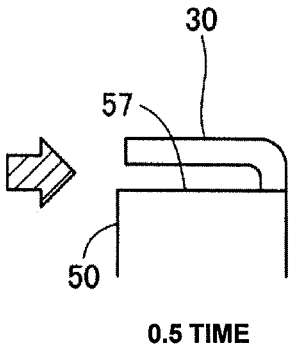
Figure 4C:
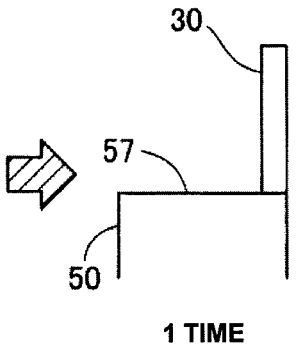

FIG. 4(*a*), FIG. 4(*b*) and FIG. 4(*c*) are schematic views showing how to perform the breaking test. In the breaking test, the ground electrode 30 was first bent inwardly from the state that the ground electrode 30 was perpendicular to the front end face 57 of the metal shell 50 (FIG. 4(*a*)) to the state that the ground electrode 30 was parallel to the front end face 57 of the metal shell 50 (FIG. 4(*b*)), and then, bent back to the state that the ground electrode 30 was perpendicular to the front end face 57 of the metal shell 50 (FIG. 4(*c*)). With regard to the number of bending of the ground electrode 30, the operation of bending the ground electrode 30 from the state of FIG. 4(*a*) to the state of FIG. 4(*b*) was counted as 0.5 times; and the operation of bending the ground electrode 30 from the state of FIG. 4(*b*) to the state of FIG. 4(*c*) was counted as 0.5 times.

The results of the above breaking test are indicated in TABLE 1. As indicated in TABLE 1, the breaking test was performed on the samples in which the original thickness ET1 and original width EW1 of the ground electrode 30 were follows: ET1=1.1 mm and EW1=2.2 mm (sample Nos. 1 to 4); ET1=1.3 mm and EW1=2.7 mm (sample Nos. 5 to 9); and ET1=1.6 mm and EW1=2.8 mm (sample Nos. 10 to 14).

TABLE 1

| | Thickness direction | | | Width direction | |
|---|---|---|---|---|---|
| Sample No. | ET1 (mm) | Condition 3 CS/ES | ET2 − ET1 (mm) | EW1 (mm) | Condition 2 (EW2 − EW1)/EW1 |
| 1 | 1.1 | 1.17 | 0.03 | 2.2 | 0.07 |
| 2 | 1.1 | 1.20 | 0.10 | 2.2 | 0.10 |
| 3 | 1.1 | 1.32 | 0.14 | 2.2 | 0.16 |
| 4 | 1.1 | 1.40 | 0.20 | 2.2 | 0.23 |
| 5 | 1.3 | 1.09 | 0.04 | 2.7 | 0.09 |
| 6 | 1.3 | 1.16 | 0.08 | 2.7 | 0.16 |
| 7 | 1.3 | 1.30 | 0.14 | 2.7 | 0.30 |
| 8 | 1.3 | 1.52 | 0.25 | 2.7 | 0.47 |
| 9 | 1.3 | 1.60 | 0.30 | 2.7 | 0.50 |
| 10 | 1.6 | 1.07 | 0.07 | 2.8 | 0.02 |
| 11 | 1.6 | 1.32 | 0.25 | 2.8 | 0.19 |
| 12 | 1.6 | 1.53 | 0.40 | 2.8 | 0.44 |
| 13 | 1.6 | 1.70 | 0.55 | 2.8 | 0.68 |
| 14 | 1.6 | 1.60 | 0.43 | 2.8 | 0.52 |

| Sample No. | Embedment Amount Condition 1 BD (mm) | Fused Layer Condition 4 MH (μm) | Number of bending | Judgment result |
|---|---|---|---|---|
| 1 | 0.03 | 2 | 1.5 | X |
| 2 | 0.15 | 10 | 2.5 | ◎ |
| 3 | 0.21 | 35 | 2.5 | ◎ |
| 4 | 0.36 | 80 | 3.5 | ◎ |
| 5 | 0.05 | 5 | 0.5 | X |
| 6 | 0.11 | 9 | 1.5 | X |
| 7 | 0.33 | 40 | 3.0 | ◎ |
| 8 | 0.37 | 130 | 4.5 | ◎ |
| 9 | 0.40 | 185 | 5.0 | ◎ |
| 10 | 0.07 | 7 | 1.5 | X |
| 11 | 0.27 | 110 | 4.5 | ◎ |
| 12 | 0.39 | 160 | 4.0 | ◎ |
| 13 | 0.70 | 270 | 0.5 | X |
| 14 | 0.40 | 200 | 5.0 | ◎ |

In each of the sample Nos. 2, 3, 4, 7, 8, 9, 11, 12 and 14, the number of bending times of 2.5 or more was secured (the judgment result was ◎) in the breaking test as shown in TABLE 1. Hereinafter, the samples judged as ◎ will be verified for the respective parameter ranges of the above conditions.

The condition 1 will be first verified below. In the samples where the number of bending times was 2.5 times or more, the minimum value of the embedment amount BD was 0.15 mm; and the maximum value of the embedment amount BD was 0.40 mm By contrast, the number of bending times was less than 2.5 in each of the samples where the embedment amount BD was out of the above range. It was confirmed by these results that it is possible to secure the joint strength between the ground electrode 30 and the metal shell 50 by controlling the embedment amount BD to be 0.15 to 0.40 mm.

Next, the condition 2 will be verified below. In the samples where the number of bending times was 2.5 times or more, the minimum value of the width-direction deformation rate (=(EW2−EW1)/EW1) was 0.10 (=10%); and the maximum value of the width-direction deformation rate was 0.52 (=52%). It was thus confirmed that it is necessary to control the width-direction deformation rate to be at least 0.10 (preferably 0.16 or higher) in order to secure the number of bending times of 2.5 or more.

The condition 3 will be next verified below. In the samples where the number of bending times was 2.5 or more, the minimum value of the removed surface area ratio (=CS/ES) was 1.2 (=120%); and the maximum value of the removed surface area ratio was 1.6 (=160%). By contrast, the number of bending times was less than 2.5 in each of the samples where the removed surface area ratio was out of the above range. It was confirmed by these results that it is possible to secure the joint strength between the ground electrode 30 and the metal shell 50 by controlling the removed surface area ratio to be 1.2 to 1.6.

The condition 4 will be verified below. In the samples where the number of bending times was 2.5 or more, the minimum value of the fused layer thickness MH was 10 μm; and the maximum value of the fused layer thickness MH was 200 μm. The number of bending times was less than 2.5 in each of the samples where the fused layer thickness MH was out of the above range. It was confirmed by these results that it is possible to secure the joint strength between the ground electrode 30 and the metal shell 50 by controlling the fused layer thickness MH to be 10 to 200 μm. It is generally likely that, when the fused layer ML between the ground electrode 3 and the metal shell 50 is large in thickness, breakage of the ground electrode 30 will occur starting from such a part. For instance, the number of bending times was only 0.5 in the sample No. 13 where the fused layer thickness MH was 270 μm and was larger than those of the other samples. When fused layer thickness MH falls within the above range, the fused layer ML can be made relatively small in thickness so as to secure the joint strength between the ground electrode 30 and the metal shell 50.

Figure 5A:
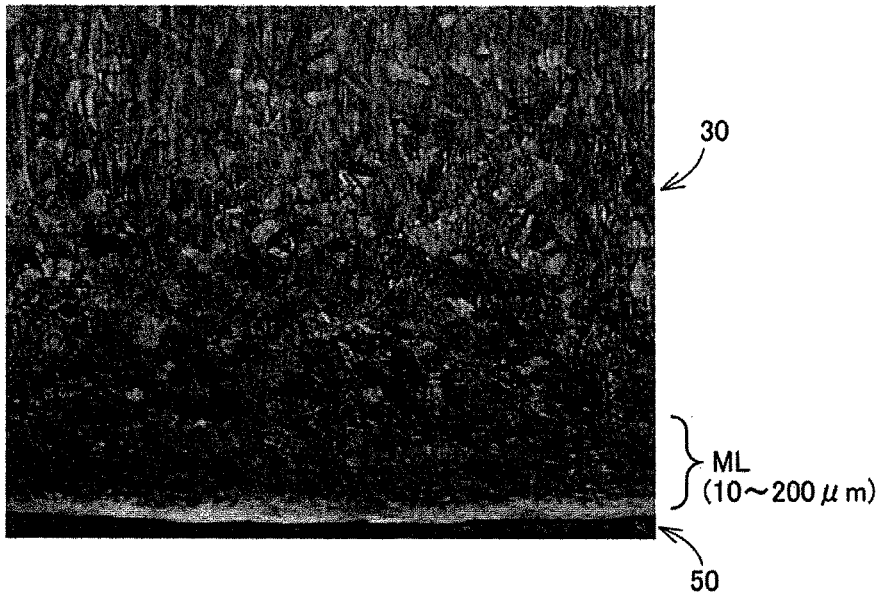
FIG. 5(*a*) and FIG. 5(*b*) are images of cross sections of fused layers and vicinities thereof taken by an electron microscope.
Figure 5B:
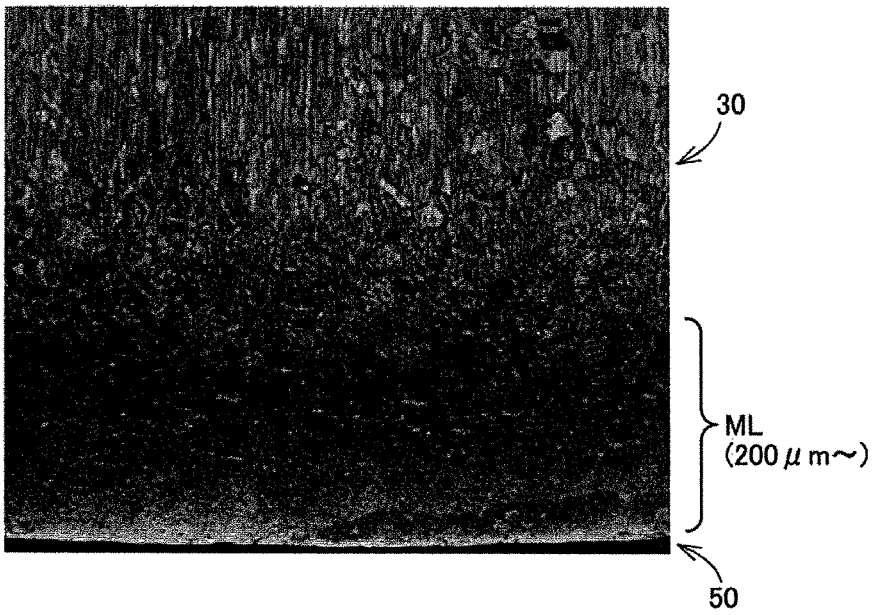

Cross-sectional images of fused layers MS and vicinities thereof taken by an electron microscope are shown in FIG. 5(*a*) and FIG. 5(*b*). More specifically, FIG. 5(*a*) is an electron microscopic image of the cross section of the sample where the fused layer thickness MH satisfied the condition 4 (10 μm≤MH≤200 μm); and FIG. 5(*b*) is an electron microscopic image of the cross section of the sample where the fused layer thickness MH did not satisfy the condition 4. The fused layer thickness MH, that is, the parameter of the condition 4 was determined by identifying a region of the fused layer where the crystal grain size was 20 μm or less on the cross-sectional image of FIG. 5 visually or by a computer, and then, measuring the thickness of this region on the cross-sectional image. By such measurement method, it was found that the grain size of the crystal in the fused layer ML was smaller than that in any portion of the ground electrode 30 other than the fused layer ML.

Figure 6A:
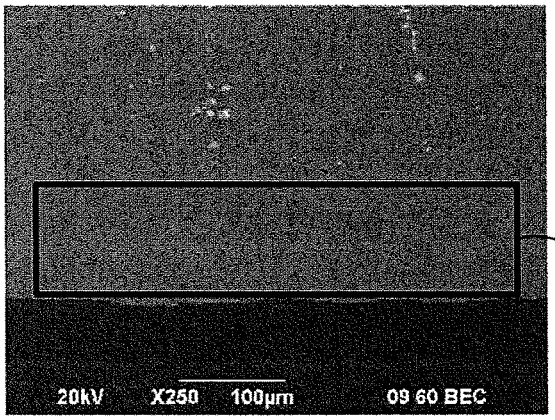
FIG. 6(*a*), FIG. 6(*b*) and FIG. 6(*c*) are images of crystal structures taken at cross sections of fused layers by an electron microscope.
Figure 6B:
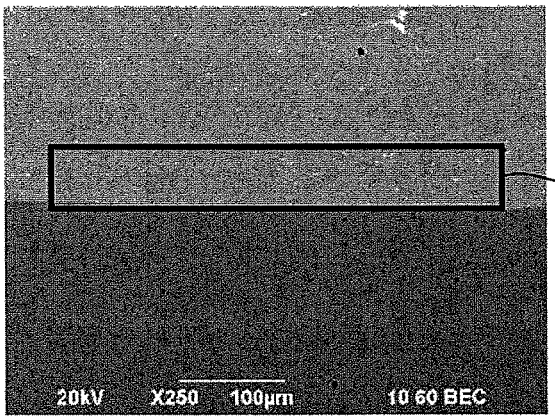
Figure 6C:
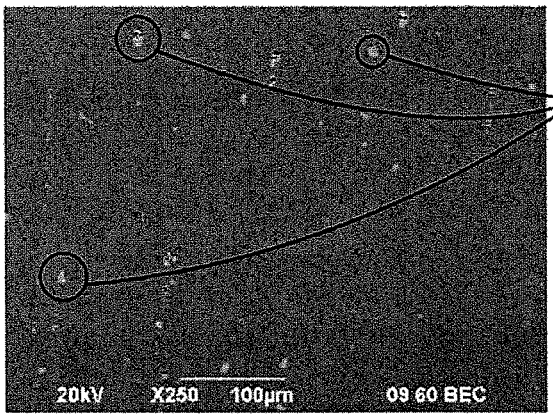

Next, the condition 5 will be verified below. Among the samples shown in TABLE 1, the typical four samples where the judgment result was ◎ (sample Nos. 2, 8, 12 and 14) and the typical two samples where the judgment result was × (sample Nos. 1 and 13) were selected. The crystal structure of the cross section of the fused layer ML in each of the selected samples was observed by an electron microscope. The enlarged image of the crystal structure taken by the electron microscope was checked for the presence or absence of a supersaturated solid solution or intermetallic compound of 5 μm or less crystal grain size as the rare earth compound containing the rare earth element in the fused layer ML. The check results are indicated in TABLE 2. Further, the electron microscopic images of the crystal structures at the cross sections of the fused layers ML are shown in FIG. 6(*a*), FIG. 6(*b*) and FIG. 6(*c*).

TABLE 2

| Sample No. | Judgment result | Fused layer MH (μm) | Super-saturated solid solution | Intermetallic compound: Crystal grain size: 5 μm or less | Intermetallic compound: Crystal grain size: 5 to 20 μm |
|---|---|---|---|---|---|
| 1 | X | 2 | absent | absent | present |
| 2 | ◎ | 10 | absent | present | absent |
| 8 | ◎ | 80 | present | present | absent |
| 12 | ◎ | 160 | present | absent | absent |
| 13 | X | 270 | absent | absent | present |
| 14 | ◎ | 200 | present | absent | absent |

As shown in TABLE 2, either the supersaturated solid solution or the intermetallic compound of 5 μm or less crystal grain size was observed in the fused layer ML in each of the samples where the judgment result was ◎ (samples Nos. 2, 8, 12 and 14). FIG. 6(*a*) is a cross-sectional image of the sample where the supersaturated solid solution was observed. FIG. 6(*b*) is a cross-sectional image of the sample where the intermetallic compound of 5 μm or less crystal grain size was observed. The intermetallic compound of 5 μm or less crystal grain size was identified in the sample No. 2 (MH=10 μm) where the fused layer thickness MH was relatively small, whereas the supersaturated solid solution was identified in the sample No. 12 (MH=160 μm) and No. 14 (MH=200 μm) where the fused layer thickness was relatively large. Both of the supersaturated solid solution and the intermetallic compound of 5 μm or less crystal grain size were identified in the sample No. 8 (MH=80 μm) where the fused layer thickness MH was between those of the above samples.

By contrast, the intermetallic compound having a relatively large crystal grain size of 5 to 20 μm was observed in the fused layer in each of the samples where the judgment result was × (sample Nos. 1 and 13). FIG. 6(*c*) is a cross-sectional image of the sample where the intermetallic compound of 5 to 20 μm crystal grain size was observed.

It was confirmed by the test results of TABLE 2 that it is possible to secure the joint strength between the ground electrode 30 and the metal shell 50 by the presence of at least one of the supersaturated solid solution containing the rare earth element and the intermetallic compound containing the rare earth element and having a crystal grain size of 5 μm or less in the fused layer ML. The reason for this is assumed to be that: by the presence of the supersaturated solid solution in the fused layer ML, the entry of foreign substance can be prevented so as to increase the grain bond strength of the fused layer; and the stress can be easily distributed by the presence of the intermetallic compound having a relatively small grain size of 5 μm or less in the fused layer ML. It is herein noted that, although the crystal grain size of the supersaturated solid solution cannot be observed because of the chemical properties of the supersaturated solid solution, the supersaturated solid solution has the property of causing a solid solution of rare earth element by cooling rapidly after heating at 1300 to 1400° C. Thus, the presence or absence of the supersaturated solid solution can be judged accurately by performing such a treatment on the fused layer ML.

As is evident from the experimental results of TABLES 1 and 2, it is possible to secure the joint strength between the ground electrode 30 and the metal shell 50 by satisfaction of the above-mentioned conditions 1 to 5 (at least the conditions 1 and 2) even when the spark plug 100 is downsized to e.g. a small diameter level of M12, M10, M8 or smaller.

Although the specific exemplary embodiment and examples of the present invention has been described above, the present invention is not limited to these exemplary embodiment and examples. Various modifications and variations of the present invention are possible without departing from the scope of the present invention. For example, the number of the ground electrode 30 joined to the metal shell 50 is not limited to 1. A plurality of ground electrode 30 may be joined to the metal shell 50.

The invention claimed is:

1. A spark plug, comprising:

a center electrode extending in an axial direction of the spark plug;

a ground electrode formed of a metal material containing 95 mass % or more of nickel; and a substantially cylindrical metal shell having a front end face to which one end of the ground electrode is welded, wherein an embedment amount BD, an original width EW1 and a deformation width EW2 satisfy the conditions:

0.15 mm≤BD≤0.40 mm; and (EW2−EW1)/EW1≥0.1 where the embedment amount BD is a depth from the front end face of the metal shell to a portion of the ground electrode embedded most deeply in the metal shell by the welding of the ground electrode and the metal shell; the original width EW1 is a width of a portion of the ground electrode located closest to a portion of the ground electrode deformed by the welding; and the deformation width EW2 is a width of the portion of the ground electrode deformed by the welding at the front end face of the metal shell;

wherein the spark plug has a removed surface region defined by removing, in the axial direction, at least a portion of a protruded part that has been formed in a thickness direction of the ground electrode by the welding of the ground electrode and the metal shell; and wherein a removed surface area CS and a ground electrode cross-sectional area ES satisfy the condition: CS/ES≥1.2, where the removed surface area CS is an area of the removed surface region; and the ground electrode cross-sectional area ES is an area of a cross section taken perpendicular to the axial direction through the portion of the ground electrode located closest to the portion of the ground electrode deformed by the welding.

2. The spark plug according to claim 1, wherein the removed surface area CS and the ground electrode cross-sectional area ES satisfy the condition: CS/ES≥1.6.

3. A spark plug, comprising:

a center electrode extending in an axial direction of the spark plug;

a ground electrode formed of a metal material containing 95 mass % or more of nickel;

a substantially cylindrical metal shell having a front end face to which one end of the ground electrode is welded, wherein an embedment amount BD, and original width EW1 and a deformation width EW2 satisfy the conditions:

0.15 mm≤BD≤0.40 mm; and (EW2−EW1)/EW1≥0.1 where the embedment amount BD is a depth from the front end face of the metal shell to a portion of the ground electrode embedded most deeply in the metal shell by the welding of the ground electrode and the metal shell; the original width EW1 is a width of a portion of the ground electrode located closest to a portion of the ground electrode deformed by the welding; and the deformation width EW2 is a width of the portion of the ground electrode deformed by the welding at the front end face of the metal shell;

wherein the ground electrode contains a rare earth element;

wherein the spark plug comprises, at the portion of the ground electrode embedded most deeply in the metal shell, a fused layer formed of a crystal containing therein the rare earth element and having a grain size of 20 μm or less; and wherein a fused layer thickness MH satisfies the condition: 10 μm≤MH≤200 μm where the fused layer thickness MH is a thickness of the fused layer in the axial direction.

4. The spark plug according to claim 3, wherein the crystal is of a rare earth compound; and wherein the rare earth compound is a supersaturated solid solution containing the rare earth element.

5. The spark plug according to claim 3, wherein the crystal is of a rare earth compound; and wherein the rare earth compound is an intermetallic compound containing the rare earth element and having a grain size of 5 μm or less.

6. The spark plug according to claim 3, wherein the grain size of the crystal containing the rare earth element in the fused layer is smaller than that of a crystal containing the rare earth element in a portion of the ground electrode undeformed by the welding.

7. The spark plug according to claim 3, wherein at least one of neodymium, yttrium or cerium is contained as the rare earth element.

* * * * *